US006647738B1

(12) United States Patent
Zhou et al.

(10) Patent No.: US 6,647,738 B1
(45) Date of Patent: Nov. 18, 2003

(54) SUCTION MUFFLER FOR CHILLER COMPRESSOR

(75) Inventors: Wei Zhou, Indianapolis, IN (US); Mark A. Daniels, Manlius, NY (US); Edward A. Huenniger, Liverpool, NY (US); Joseph A. Catrambone, Pompey, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/263,005

(22) Filed: Oct. 2, 2002

(51) Int. Cl.[7] ..... F25D 19/00
(52) U.S. Cl. ..... 62/296; 181/403
(58) Field of Search ..... 62/296; 181/228, 181/264, 265, 266, 403

(56) References Cited

U.S. PATENT DOCUMENTS

| | | | | | |
|---|---|---|---|---|---|
| 2,675,088 | A | * | 4/1954 | McLeod | 181/265 |
| 2,838,128 | A | * | 6/1958 | Kliewer, Sr. | 181/264 |
| 3,853,201 | A | * | 12/1974 | Smale | 181/265 |
| 5,200,582 | A | * | 4/1993 | Kraai et al. | 181/256 |
| 5,444,197 | A | * | 8/1995 | Flugger | 181/264 |
| 5,584,674 | A | * | 12/1996 | Mo | 417/312 |
| 6,089,347 | A | * | 7/2000 | Flugger | 181/264 |
| 6,446,454 | B1 | * | 9/2002 | Lee et al. | 62/296 |

* cited by examiner

*Primary Examiner*—William E. Tapolcai

(57) ABSTRACT

The gas flow direction and the noise generation direction are in opposite directions in the suction muffler. The flow path in the muffler has a number of changes in direction and the flow path cross section decreases at each change of direction in the direction of flow.

15 Claims, 1 Drawing Sheet

SUCTION MUFFLER FOR CHILLER COMPRESSOR

BACKGROUND OF THE INVENTION

In positive displacement compressors, discrete volumes of gas are trapped and compressed with the trapped, compressed volumes being discharged from the compressor. The trapping of the volumes at suction pressure and their discharge at discharge pressure each produce pressure pulsations and the related noise generation. In the case of chillers, the suction pipe extends into the cooler and the suction gas pulsation in the cooler has been found to be one of the major noise sources in a chiller. This noise source becomes significant after vibration and acoustic treatments have been performed to control compressor vibration and discharge gas pulsation utilizing compressor isolators and a discharge muffler.

The flow of gas is along a flow path defined by a pressure differential and, for the suction flow, is through the suction pipe into the compressor. The direction of noise generation is not dictated by the flow direction.

The gas pulsation resulting from the intermittent nature of gas intake is exacerbated by variable speed operation which greatly extends the frequency range over which noise can be generated during operation. A suction inlet muffler, an acoustic treatment or lagging the cooler, partially or completely, can be employed for noise attenuation. While an absorptive suction muffler is an obvious choice, they are made to attenuate noise in a particular frequency range, or ranges, much less extensive than the frequency range associated with variable speed operation.

SUMMARY OF THE INVENTION

In the suction pipe of a chiller compressor the gas flow and the gas intake noise pulsations are traveling in primarily opposite directions, although some acoustic energy is reflected back towards the compressor where the suction pipe terminates in the cooler. The present invention locates a dissipative-type muffler at the inlet end of the suction pipe which is within the cooler. The inlet cross section of the muffler is oversized so as to permit a series of reductions in cross section down to the cross section of the suction pipe which is suitable for feeding the suction inlet of the compressor. The changes in the areas of the cross sections are primarily for reducing flow losses but could have slight acoustic benefits as where the wave propagation in the suction pipe is highly modal in nature, i.e. only is beneficial where the pipe cross section is small compared to an acoustic wavelength of 300 Hz, or less. The flow path through the muffler into the suction pipe involves a number of changes in flow direction. At each directional change in the muffler, the cross section of the flow path is decreased in the direction of flow. A preferred area reduction at each directional change is on the order of one third which keeps the flow and turning losses small.

It is an object of this invention to provide enhanced muffler performance.

It is another object of this invention to attenuate suction gas pulsation in a variable speed chiller compressor. These objects, and others as will become apparent hereinafter, are accomplished by the present invention.

Basically, the gas flow direction and the noise generation direction are in opposite directions in the suction muffler. The flow path in the muffler has a number of changes in direction and the flow path cross section decreases at each change of direction in the direction of flow.

BRIEF DESCRIPTION OF THE DRAWINGS

For a fuller and understanding of the present invention, reference should now be made to the following detailed description thereof taken in conjunction with the accompanying drawings wherein.

DESCRIPTION OF THE PREFERRED EMBODIMENTS

Figure 1:
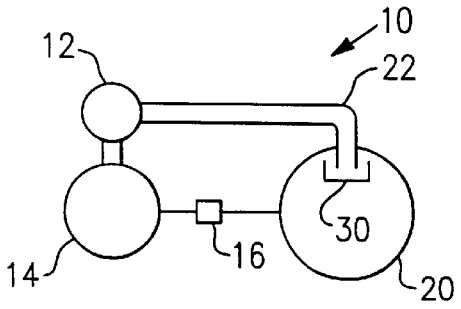
FIG. 1 is a schematic representation of a chiller employing the present invention.

In FIG. 1, the numeral 10 generally designates a chiller. Chiller 10 includes a positive displacement compressor 12, such as a screw compressor, which discharges hot, compressed refrigerant gas into condenser 14. The gaseous refrigerant condenses in condenser 14 and high pressure liquid refrigerant passes from condenser 14 to cooler 20 via expansion device 16 whereby the liquid refrigerant partially flashes. The refrigerant is in a heat exchange relationship with water, or the like) in cooler 20 such that the liquid refrigerant is evaporated and the water is cooled so as to be available for air conditioning. The gaseous refrigerant is drawn from cooler 20 by compressor 12 via suction muffler 30 and suction pipe 22. Suction pipe 22 is sized to deliver suction gas to compressor in the absence of a muffler and all of the flow path segments in the muffler are successively larger in cross section at each change in flow direction in an upstream direction.

Figure 2:
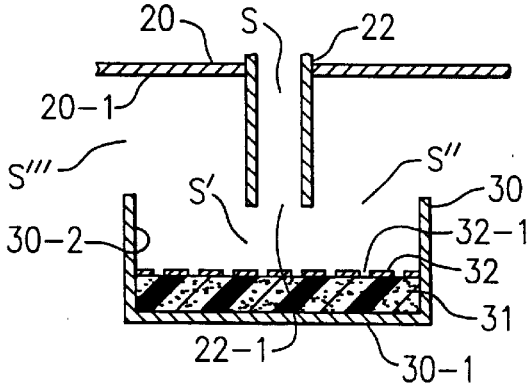
FIG. 2 is a cross section of a suction muffler made according to the teachings of the present invention.

As best shown in FIG. 2, suction pipe 22 extends downwardly into cooler 20 and is received in a spaced relationship within muffler 30. Muffler 30 is in the form of an annular cylinder with one closed end 30-1. End 30-1 is serially overlain by an acoustical lining 31, such as fiberglass, and a perforate member 32 which may be metal or plastic and preferably having a porosity of 40–70%. Member 32 faces and is spaced from the inlet end 22-1 of suction pipe 22. For the purposes of the present invention, a change in flow direction will normally be a nominal 90° . Other angles are possible but make the device less compact.

Assuming that the cross sectional area of suction pipe 22 is S, the area of the surface S' defined by the extension of pipe 22 to perforate member 32 is greater than S. Preferably S' is 125% to 175% of S with 150% being preferred. The area of the annular area S" defined between annular wall 30-2 of muffler 30 and suction pipe 22 will be 125% to 175% of S' with 150% being preferred. Wall 30-2 is spaced from inner surface 20-1 of cooler 20 and the area of the surface S'" defined by the extension of wall 30-2 to the inner surface

20-1 is greater than S". Preferably S'" is 125% to 175% of S" with 150% being preferred.

Operation of compressor 12 serially draws gaseous refrigerant from cooler 20 through muffler 30 in a flow path serially having the reduced cross sections of S'", S" and S' before entering suction pipe 22 which has a cross section of S. The reductions in cross section at the locations of change in the flow direction keeps flow/turning losses small. The noise generated by the suction process in compressor 12 reflects along the interior of suction pipe 22 before impinging upon the surface defined by perforate member 32 and the underlying acoustical lining 31. Sound passing through perforations 32-1 of perforate member 32 are attenuated by acoustical lining 31.

Figure 3:
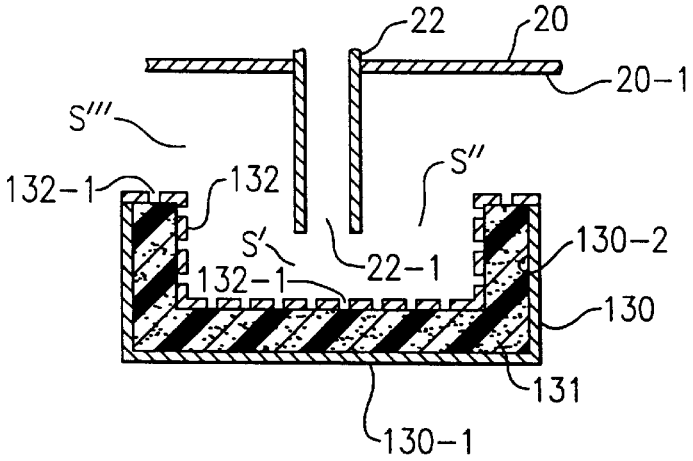
FIG. 3 is a cross section of a modified suction muffler.
Figure 4:
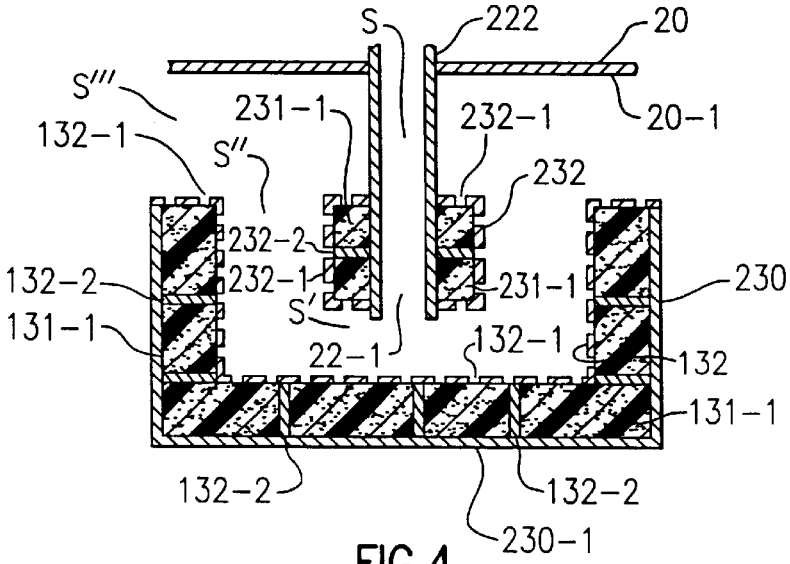
FIG. 4 is a cross section of a second modified suction muffler.

Muffler 130 of FIG. 3 is the same as muffler 30 except that acoustical lining 131 covers both end 130-1 and annular wall 130-2 and is overlain by perforate member 132. The additional flow path length over the portion of perforate member 132 covering the wall 130-2 and the underlying acoustical lining 131 would tend to provide increased flow resistance over muffler 30 but the oversized flow path cross section area, S", in that region mitigates flow losses. Additionally, flow is over perforate member 132 and its perforations 132-1 in passing through the area having cross section S'". The increased area provided by perforate member 132, perforations 132-1 and the acoustical lining 131 for noise impingement provides further attenuation.

Muffler 230 is the same as muffler 130 except that the outer end portion of suction pipe 222 has been covered with acoustical segments lining 231-1 which is spaced by spacer (s) 232-2 overlain by perforate member 232 having perforations 232-1 and acoustical lining 131 has been replaced by a series of segments 131-1 spaced by spacers 132-2. Acoustic liners 31 and 131 are illustrated as bulk type liners but could be of the locally reacting type such as acoustic liner segments 131-1. Because acoustic liner segments 131-1 and 231-1 are separated by spacers 132-2 and 232-2, respectively, acoustic wave propagation in the liner segments 131-1 and 231-1 is prevented so that there is primarily propagation normal to the liner only. This results in enhanced low frequency performance where the distance between spacers 132-2 is small compared to the acoustic wavelength, i.e. less than about one eighth of the wavelength. The flow path between perforate members 132 and 232 would have the cross sectional areas S", as defined above. Perforate member 132 is spaced from inner surface 20-1 of cooler 20 and the area of the surface S'" defined between perforate member 132 to the inner surface 20-1 is greater than S". Preferably S'" is 125% to 175% of S" with 150% being preferred.

Muffler 230 has an additional flow path length over the perforate member 232 when compared to muffler 130 but the oversized flow path cross sectional area S" in that region mitigates flow losses. The provision of a flow path portion where noise reflects and impinges between two perforate members underlain by acoustical lining provides further attenuation. The shape of spacers 132-2 and 232-2 is arbitrary in that they only need to block wave travel longitudinally between liner segments 131-1 and 231-1, respectively, and can be a series of annular discs for the annular walls and spaced circles or a grid for end 230-1.

Although preferred embodiments of the present invention have been illustrated and described other changes will occur to those skilled in the art. It is therefore intended that the scope of the present invention is to be limited only by the scope of the appended claims.

What is claimed is:

1. A muffler and a suction pipe with an inlet and a cross sectional area, said muffler coacting with said suction pipe to define a flow path having an inlet and a plurality of changes in flow direction and terminating at said inlet of said suction pipe with said flow path having a cross sectional area which serialy reduces at each change in flow direction in the direction of flow.

2. The muffler of claim 1 wherein each reduction in cross sectional area of said flow path is at least 25%.

3. The muffler of claim 1 wherein at least part of said flow path is made up of a perforate material underlain by an acoustical material.

4. The muffler of claim 3 wherein the perforate member has a porosity of at least 40%.

5. The muffler of claim 3 wherein at least a portion of said acoustical material is made up of a plurality of segments separated by spacers.

6. A chiller including a cooler and a compressor with a suction pipe having an inlet and extending into said cooler, a muffler in said cooler and coacting with said suction pipe to define a fluid path extending from the interior of said cooler to said inlet of said suction pipe, and having a plurality of changes of direction, said suction pipe having a cross sectional area and said fluid path having an increased cross sectional area at each change of direction when starting at said inlet of said suction pipe and going towards the interior of said cooler.

7. The chiller of claim 6 wherein each increase of cross sectional area is at least 125% of the cross section of the adjacent region.

8. The chiller of claim 6 wherein at least part of said flow path is made up of a perforate material underlain by an acoustical material.

9. The chiller of claim 8 wherein the perforate member has a porosity of at least 40%.

10. The chiller of claim 8 wherein at least a portion of said acoustical material is made up of a plurality of segments separated by spacers.

11. A muffler and a suction pipe with an inlet and a cross sectional area, said muffler being spaced from and coacting with said suction pipe to define a flow path through the space between said suction pipe and said muffler with said flow path having an inlet and a plurality of changes in flow direction and terminating at said inlet of said suction pipe with said flow path having a cross sectional area which reduces at each change in flow direction.

12. The muffler of claim 11 wherein each reduction in cross sectional area of said flow path is at least 25%.

13. The muffler of claim 11 wherein at least part of said flow path is made up of a perforate material underlain by an acoustical material.

14. The muffler of claim 13 wherein the perforate member has a porosity of at least 40%.

15. The muffler of claim 13 wherein at least a portion of said acoustical material is made up of a plurality of segments separated by spacers.

* * * * *